US005194029A

United States Patent [19]

Kinoshita

[11] Patent Number: 5,194,029

[45] Date of Patent: Mar. 16, 1993

[54] FLOATABLE STRUCTURE PROPELLING MECHANISM

[75] Inventor: Koichi Kinoshita, Tokyo, Japan

[73] Assignee: Jal Data Communications & Systems Co., Ltd., Tokyo, Japan

[21] Appl. No.: 906,848

[22] Filed: Jun. 30, 1992

Related U.S. Application Data

[63] Continuation-in-part of Ser. No. 819,207, Jan. 10, 1992, which is a continuation of Ser. No. 658,608, Feb. 21, 1991, abandoned.

[30] Foreign Application Priority Data

Sep. 5, 1990 [JP] Japan ..... 2-233301
Oct. 19, 1990 [JP] Japan ..... 2-112103

[51] Int. Cl.[5] ..... A63H 27/00
[52] U.S. Cl. ..... 446/35; 244/28; 446/59; 446/156
[58] Field of Search ..... 244/28, 11, 22, 72, 244/30, 123, 901, 902; 446/35, 59, 60, 156, 158, 164, 163; 440/14, 15

[56] References Cited

U.S. PATENT DOCUMENTS

| | | | |
|---|---|---|---|
| 1,758,178 | 5/1930 | Slinn | 446/35 |
| 1,907,887 | 5/1933 | Spencer | 446/35 |
| 3,728,814 | 4/1973 | Ruston | 446/35 |
| 4,195,438 | 4/1980 | Dale et al. | 446/35 |
| 4,729,748 | 3/1988 | Van Raymbake | 446/35 |

FOREIGN PATENT DOCUMENTS

| | | | |
|---|---|---|---|
| 0547738 | 10/1957 | Canada | 446/35 |
| 0017154 | of 1910 | United Kingdom | 446/35 |

*Primary Examiner*—Joseph F. Peters, Jr.
*Assistant Examiner*—Christopher P. Ellis
*Attorney, Agent, or Firm*—Lowe, Price, LeBlanc & Becker

[57] ABSTRACT

A floatable structure propelling mechanism is combined with a floatable structure filled with helium gas to propel the floatable structure for flying in the air. The floatable structure propelling mechanism comprises a pair of lateral fins supported for swing motion respectively on the opposite sides of a middle portion of the floatable structure. The driving mechanism for driving the lateral fins for swing motion alternately in opposite direcitons in a vertical plane comprises a rotative driving unit provided near the lower surface of the middle portion of the floatable structure. The rotative driving unit includes a double crankshaft which is rotated by the driving unit, first connecting rods fixed to the lateral fins, respectively, and second connecting rods interconnecting the crank pin portions of the double crankshaft and the free ends of the first connecting rods, respectively. The lateral fins include a framework which permits flexing of each lateral fin to relax the fin and decrease resistance to air during upward motion. During downward motion, the framework of the lateral fins attains a rigid configuration to tension the lateral fin and provide improved lift for propelling the floatable structure for flying.

16 Claims, 12 Drawing Sheets

FIG. 14
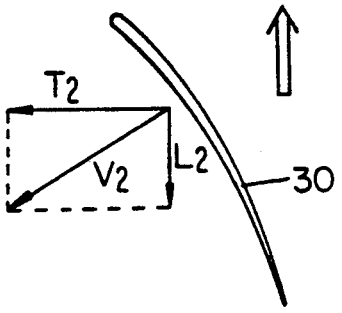
FIG. 15
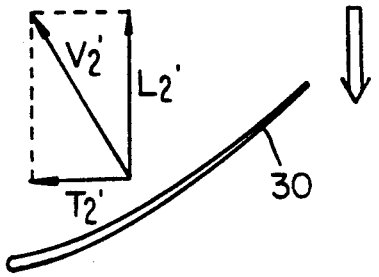
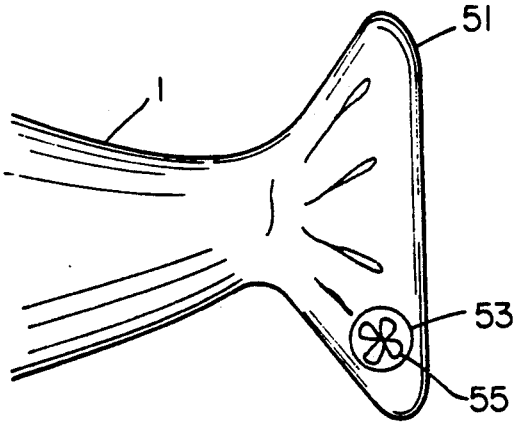
FIG. 16

FLOATABLE STRUCTURE PROPELLING MECHANISM

This is a continuation-in-part application of U.S. Ser. No. 07/819,207 filed Jan. 10, 1992 which is a continuation application of U.S. Ser. No. 07/658,608 filed Feb. 21, 1991, now abandoned.

FIELD OF THE INVENTION

The present invention relates to a floatable structure propelling mechanism for propelling a floatable structure, such as a flying toy or a floatable advertising medium.

DESCRIPTION OF THE PRIOR ART

A model plane, i.e., one of various flying toys, employs a screw propeller for propulsion and, in general, employs a torsional driving means, such as a rubber cord, as a motive power source for rotating the screw propeller. Requiring a relatively small torque, the screw propeller is rotated at a relatively high rotating speed by the torsional driving means to generate a relatively large propulsion. When a rubber cord is used as a motive power source, however, the driving energy stored in the rubber cord by twisting the same is exhausted rapidly in a relatively short time and hence the model plane is unable to fly at a relatively low flying speed for a long time. To enable the model plane to fly for a long time, a long rubber cord or a plurality of rubber cords are used, which, however, increases the weight of the rotative driving means. Furthermore, the screw propeller rotating at a high rotating speed may possibly injure babies.

SUMMARY OF THE INVENTION

Accordingly, it is an object of the present invention to provide an inexpensive, safe, floatable structure propelling mechanism employing a small rotative driving means, capable of propelling a floatable structure filled with a gas lighter than air and floating in the air in a well balanced attitude at a very low flying speed for a sufficiently long time.

In one aspect of the present invention, a floatable structure propelling mechanism for propelling a floatable structure comprises: a vertical fin pivotally supported for swing motion alternately in opposite directions in a horizontal plane on a rear end of the floatable structure; a rotative driving unit supported on the floatable structure; a first crankshaft interlocked with the rotative driving unit; a second crankshaft having a crank journal fixed to the vertical fin; and a connecting rod having one end connected to the crank pin portion of the first crankshaft and the other end connected to the crank pin portion of the second crankshaft.

The rotative driving unit having a motive power source, such as a rubber cord, a spiral spring or a motor, rotates the first crankshaft to reciprocate the connecting rod, whereby the vertical fin is swung alternately in opposite directions in a horizontal plane for propulsion by the second crankshaft connected to the other end of the connecting rod and, consequently, the floatable structure advances slowly by means of reaction to the air urged backward by the vertical fin.

In another aspect of the present invention, a floatable structure propelling mechanism for propelling a floatable structure comprises: a pair of lateral fins supported for swing motion respectively on the opposite sides of the middle portion of the floatable structure filled with a gas lighter than air, a driving mechanism for driving the lateral fins for swing motion alternately in opposite directions in a vertical plane, comprising a rotative driving unit provided near the lower surface of the substantially middle portion of the floatable structure, a double crankshaft which is rotated by the rotative driving unit, connecting rods fixed to the lateral fins, respectively, and connecting rods interconnecting the crank pin portions of the double crankshaft and the free ends of the connecting rods, respectively.

When the double crankshaft is rotated by the rotative driving unit, the lateral fins are swung alternately in opposite directions in a vertical plane, whereby the floatable structure advances by means of reaction to the air urged backward by the lateral fins.

In another aspect of the present invention, the pair of lateral fin supported for swing motion respectively on the opposite sides of the middle portion of the floatable structure include framework capable of flexing during upward motion of the lateral fin to relax the fin and reduce air resistance. During downward motion of the lateral fin, the flexing component returns the lateral fin to a rigid configuration so as to tension the fin to increase the air resistance and provide improved lift for the floatable structure. In a further aspect of the invention, the tail portion of one embodiment of the floatable structure includes a rotative driving unit which facilitates steering the floatable structure during forward movement.

BRIEF DESCRIPTION OF DRAWINGS

The above and other objects, features and advantages of the present invention will become more apparent from the following description taken in connection with the accompanying drawings, in which:

FIGS. 14 and 15 are diagrammatic views of assistance in explaining the dynamic action of the lateral fin shown in FIGS. 12 and 13 during upward and downward movement; and FIG. 16 is a side view of a portion of the floatable structure depicted in FIG. 6 showing another embodiment according to the present invention.

DESCRIPTION OF THE PREFERRED EMBODIMENTS

The present invention will be described hereinafter as applied to floatable structures, i.e., flying toys resembling fish.

FIRST EMBODIMENT (FIGS. 1 to 5)

Figure 1:
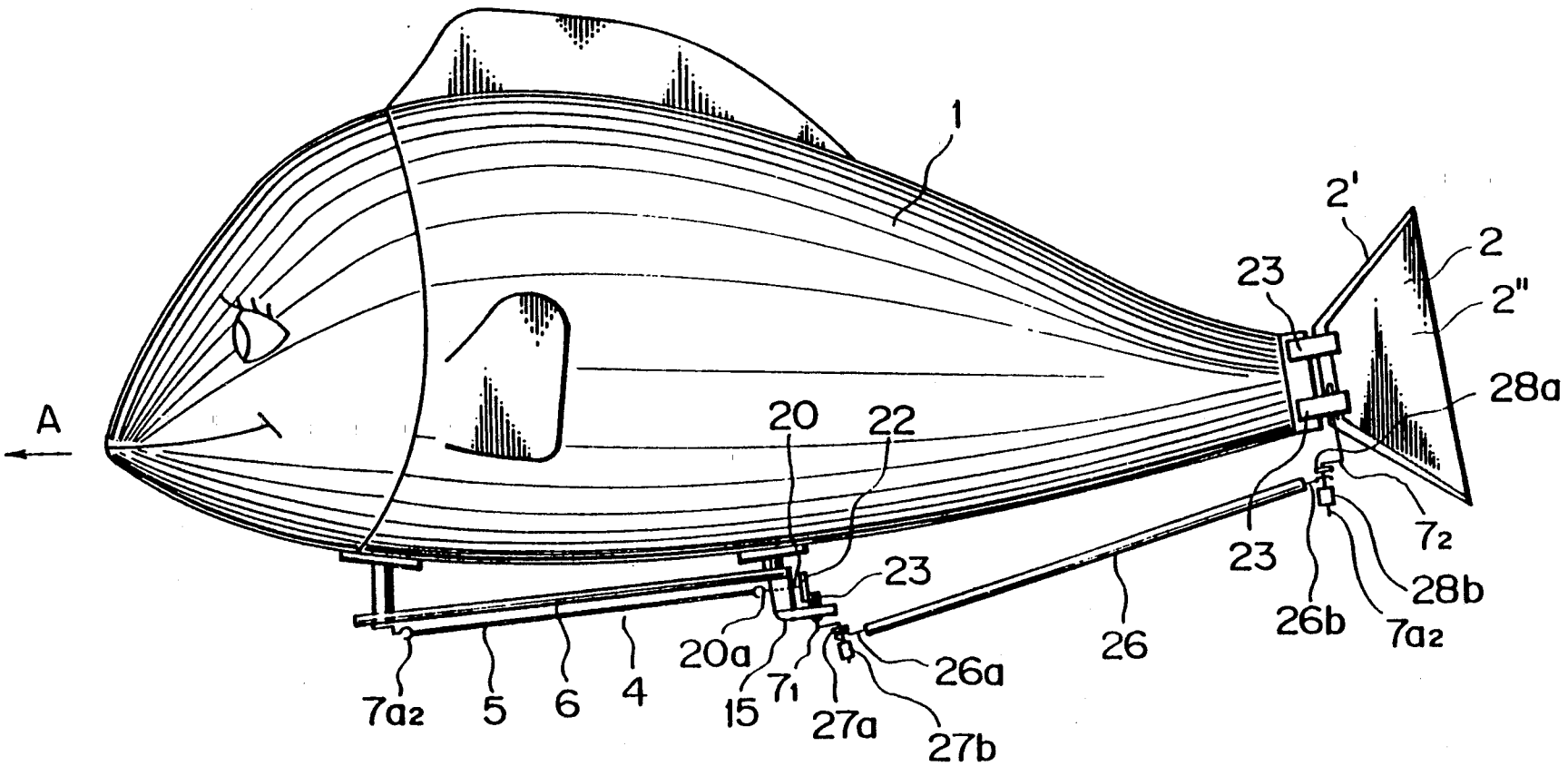
FIG. 1 is a side view of a floatable structure in the form of a fish provided with a floatable structure propelling mechanism in a first embodiment according to the present invention.
Figure 5:
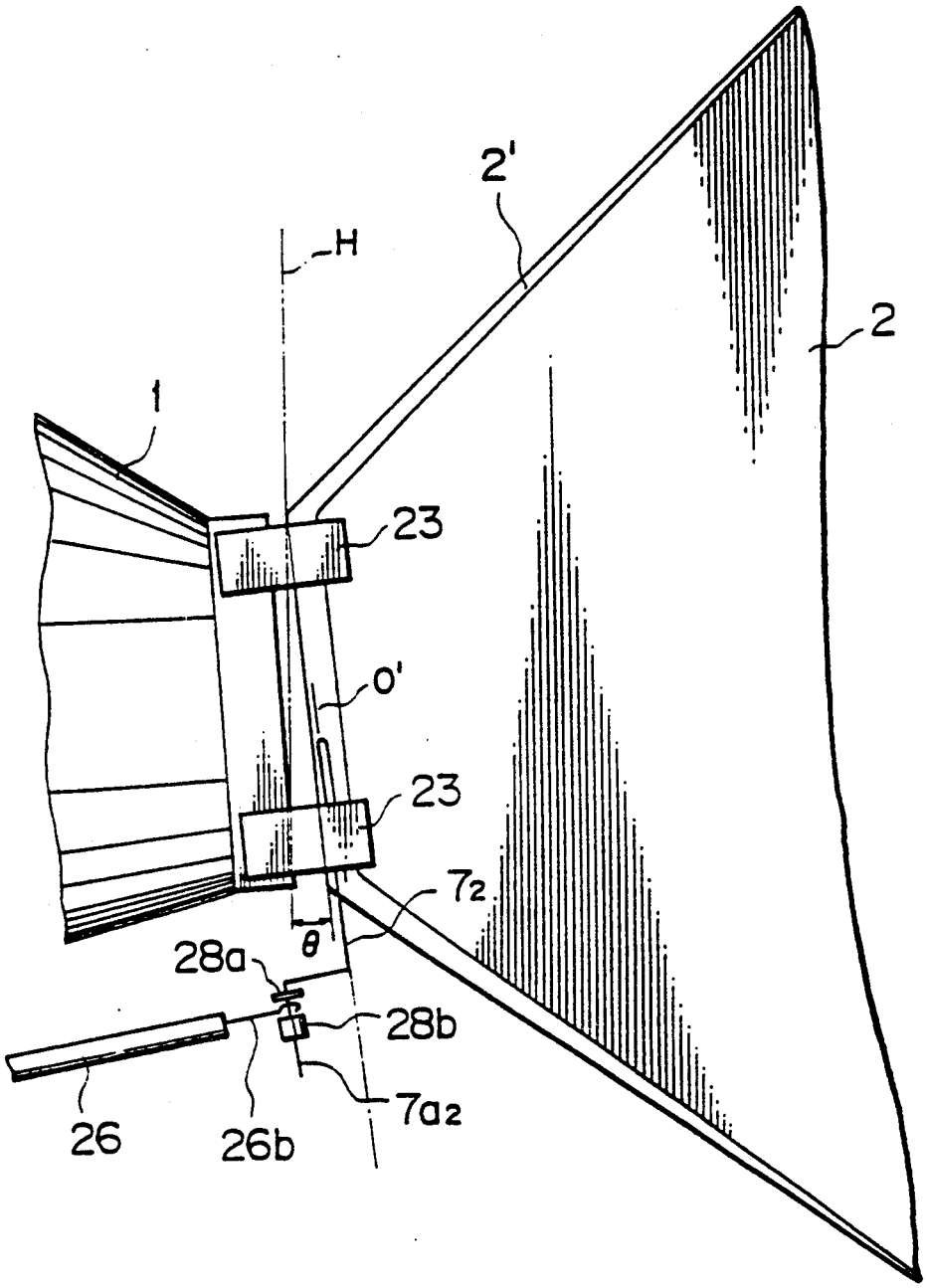
FIG. 5 is an enlarged side view of a portion of the floatable structure propelling mechanism of FIG. 1.

Referring to FIG. 1, a floatable structure 1 is formed of a lightweight, flexible material capable of maintaining a fixed morphology, such as a synthetic resin film, in the form of a fish having a hollow structure. The floatable structure 1 is filled with a gas lighter than air, such as helium gas, and is provided with a trapezoidal vertical fin 2 resembling the caudal fin of a fish, formed by spreading a film 2'' on a framework 2' formed of lightweight, flexible members, such as bamboo wires, or formed by molding a plastic. The vertical fin 2 is supported for swing motion on the rear end of the floatable structure 1 by support members 23. Each support member 23 is a soft, flexible, thin plastic strip having one end attached adhesively to the rear end of the floatable structure 1 and the other end attached adhesively to the base member of the framework 2' of the vertical fin 2. The vertical fin 2 may be supported for swing motion on the floatable structure 1 by a conventional hinge or the like. When the vertical fin 2 is formed of a plastic film integrally with the floatable structure 1, the support members 23 may be omitted. As shown in FIG. 5, the axis of swing motion of the vertical fin 2 is inclined to the front at an angle $\theta$ to a vertical reference line H so that the floatable structure 1 is propelled slightly upward.

Figure 4:
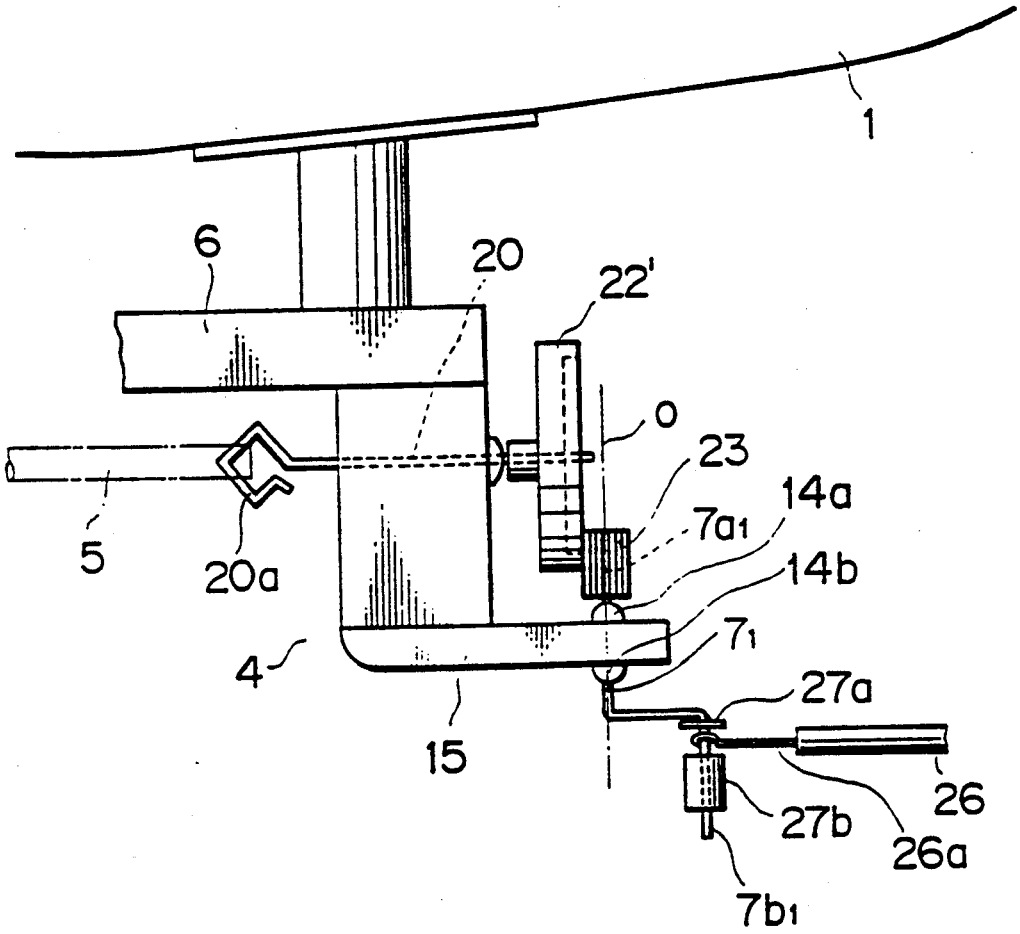
FIG. 4 is an enlarged side view of a rotative driving unit included in the floatable structure propelling mechanism of FIG. 1.

Referring to FIGS. 1, 4 and 5, a floatable structure propelling mechanism 3 of the present invention has a rotative driving unit 4. The rotative driving unit 4 comprises a support rod 6 attached to the lower surface of the floatable structure 1, a hook $7a_2$ fixed to the front end of the support rod 6, a drive shaft 20 journaled on a bearing member fixed to the rear end of the support rod 6 and provided with a hook 20*a* at its front end, a rubber cord 5, i.e., a motive power source, extended between the hooks $7a_2$ and 20*a*, a first crankshaft $7_1$ formed by bending a wire, having a crank journal portion supported in bearings 14*a* and 14*b* attached to a support plate 15 extending from the bearing member, a crown gear 22 fixed to the rear end of the drive shaft 20, and a pinion 23 mounted on the upper end of the journal portion of the crankshaft $7_1$ in mesh with the crown gear 22. The crown gear 22 and the pinion 23 forms a step-up gearing. Accordingly, a relatively large load torque acts on the crown gear 22, so that the crown gear 22, hence the drive shaft 20, is unable to rotate at a relatively high rotating speed. Consequently, the rubber cord 5 twisted to store energy is unable to be untwisted rapidly, so that the energy stored in the twisted rubber cord 5 is consumed gradually to drive the crankshaft $7_1$ for a relatively long time. The crown gear 22 and the pinion 23 may be substituted by bevel gears. The crank pin portion of the first crankshaft $7_1$ is connected to the crank pin portion $7a_2$ of a second crankshaft $7_2$ formed by bending a wire and having a crank journal portion fixed to the base member of the framework 2' of the vertical fin 2 by a connecting rod 26 having one end provided with an eyebar 26*a* engaging the crank pin portion of the first crankshaft $7_1$ and the other end provided with an eyebar 26*b* engaging the crank pin portion $7a_1$ of the second crankshaft $7_2$. The crank throw of the second crankshaft $7_2$ is greater than that of the first crankshaft $7_1$. In FIG. 1, indicated at 27*a*, 27*b*, 28*a* and 28*b* are stoppers.

Figure 2:
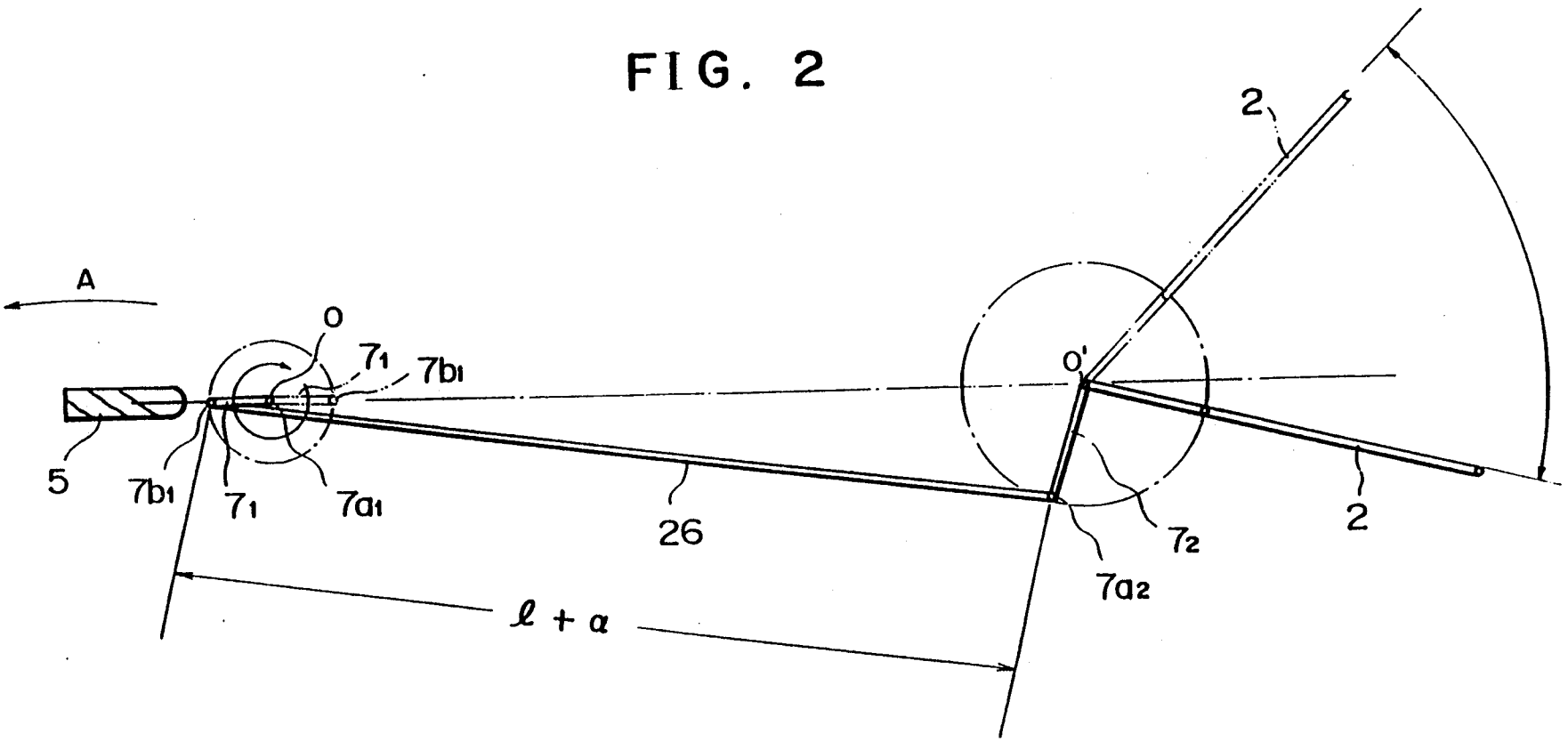
FIG. 2 is a diagrammatic plan view of the floatable structure propelling mechanism of FIG. 1, for assistance in explaining the operation and geometry of the floatable structure propelling mechanism in propelling the floatable structure along a curved line.

Referring to FIG. 2, when the first crankshaft $7_1$ is rotated about an axis O in the direction of an arrow, the connecting rod 26 is reciprocated longitudinally to turn the crank arm portion of the second crankshaft $7_2$ alternately in opposite directions in an angular range and, consequently, the vertical fin 2 is caused to swing alternately in opposite directions in an angular range, because the crank throw of the second crankshaft $7_2$ is greater than that of the first crankshaft $7_1$.

When the floatable structure 1 is released into the air after fully twisting the rubber cord 5 to store sufficient energy, the floatable structure 1 filled with helium gas floats in the air and is propelled by the propulsion of the vertical fin 2 being swung alternately in opposite directions through the connecting rod 26, the second crankshaft $7_2$, the crankshaft $7_1$, the pinion 23, the crown gear 22 and the drive shaft 20 by the rubber cord 5. The floatable structure 1 may be maintained in a balanced attitude by a ballast. Since the axis of swing motion of the vertical fin 2 is inclined to the front at an angle $\theta$ to the vertical reference line H, the floatable structure 1 is propelled substantially horizontally or slightly upward, so that the floatable structure 1 is able to fly in the air.

Figure 3:
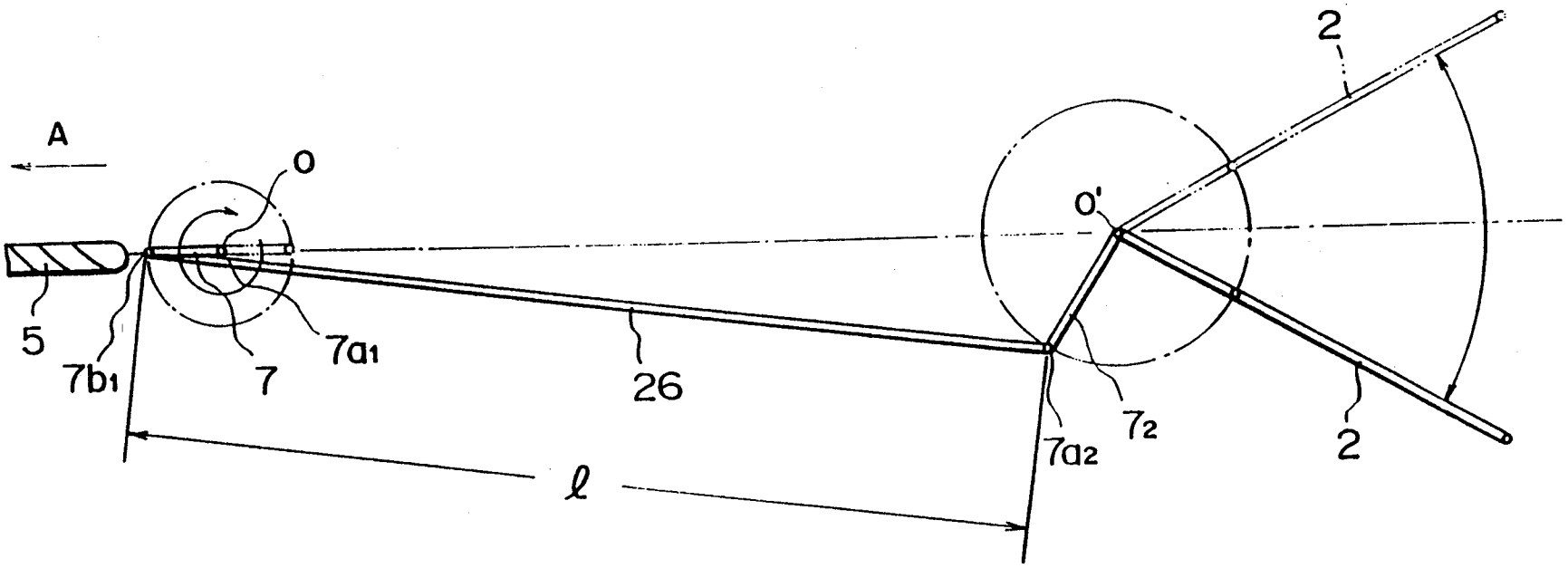
FIG. 3 is a diagrammatic plan view similar to FIG. 2, for assistance in explaining the operation and geometry of the floatable structure propelling mechanism in propelling the floatable structure along a straight line.

When the length of the connecting rod 26 is adjusted to l so that the crank pin portion $7b_1$ of the first crankshaft $7_1$ and the crank pin portion $7a_2$ of the second crankshaft $7_2$ are located as shown in FIG. 3 in an initial state where the crank angle of the crankshaft $7_1$ is zero, the vertical fin 2 is swung alternately in opposite directions through equal angles with respect to a central vertical plane of symmetry of the floatable structure 1 including the axis O of the first crankshaft $7_1$ and the axis O' of the second crankshaft $7_2$ and hence the floatable structure 1 flies substantially along a straight line. On the other hand, when the length of the connecting rod 6 is increased to $l+\alpha$ so that the center of swing motion of the vertical fin 2 is biased to the right as shown in FIG. 2, the floatable structure 1 can be propelled clockwise and, when the length of the connecting rod 26 is adjusted to $l-\alpha$, the floatable structure 1 can be propelled counterclockwise.

The rubber cord 5 employed as the motive power source of the rotative driving unit 4 may be substituted by a spiral spring or a motor.

The floatable structure propelling mechanism 3 may be formed in a mirror-image geometry with respect to that shown in FIGS. 1 and 2.

The vertical fin 2 may be substituted by a horizontal fin and the arrangement of the rotative driving unit 4 may be changed accordingly.

The floatable structure 1 may be provided with a plurality of propelling fins.

The floatable structure propelling mechanism in this embodiment may be applied to a floatable structure to be propelled in water.

SECOND EMBODIMENT (FIGS. 6 to 11)

Figure 6:
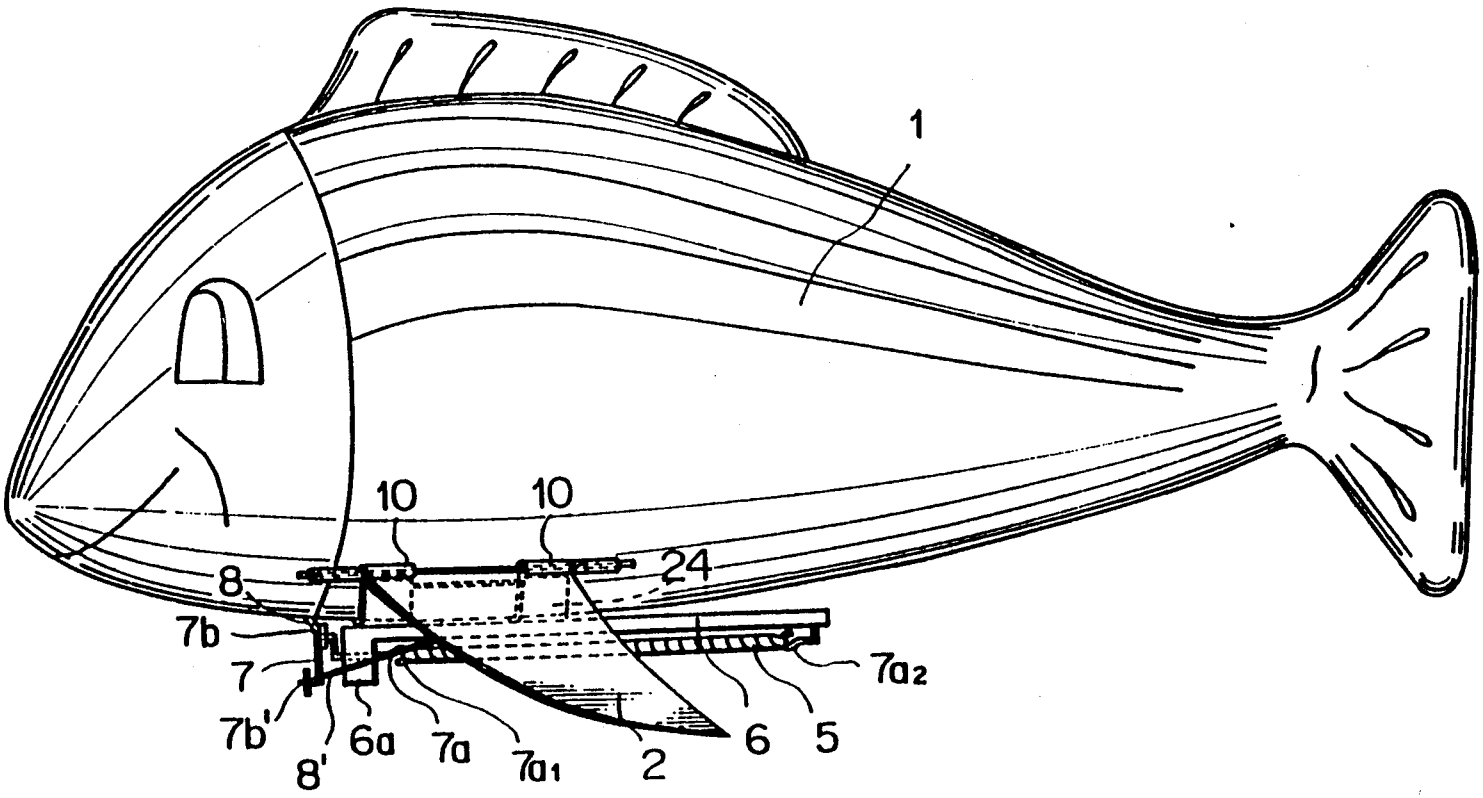
FIG. 6 is a view of a floatable structure in the form of a fish provided with a floatable structure propelling mechanism in a second embodiment according to the present invention.

Referring to FIG. 6, a floatable structure 1 is formed of a lightweight, flexible material capable of maintaining a fixed morphology, such as a synthetic resin film, in the form of a fish having a hollow structure and is provided with a floatable structure propelling mechanism 3 including a rotative driving unit 4 and lateral fins 2 resembling the pectoral fins of a fish. The floatable structure 1 is inflatable to permit filling with a gas lighter than air, such as helium gas. The buoyancy and attitude of the floatable structure 1 is adjusted by a ballast.

Figure 8:
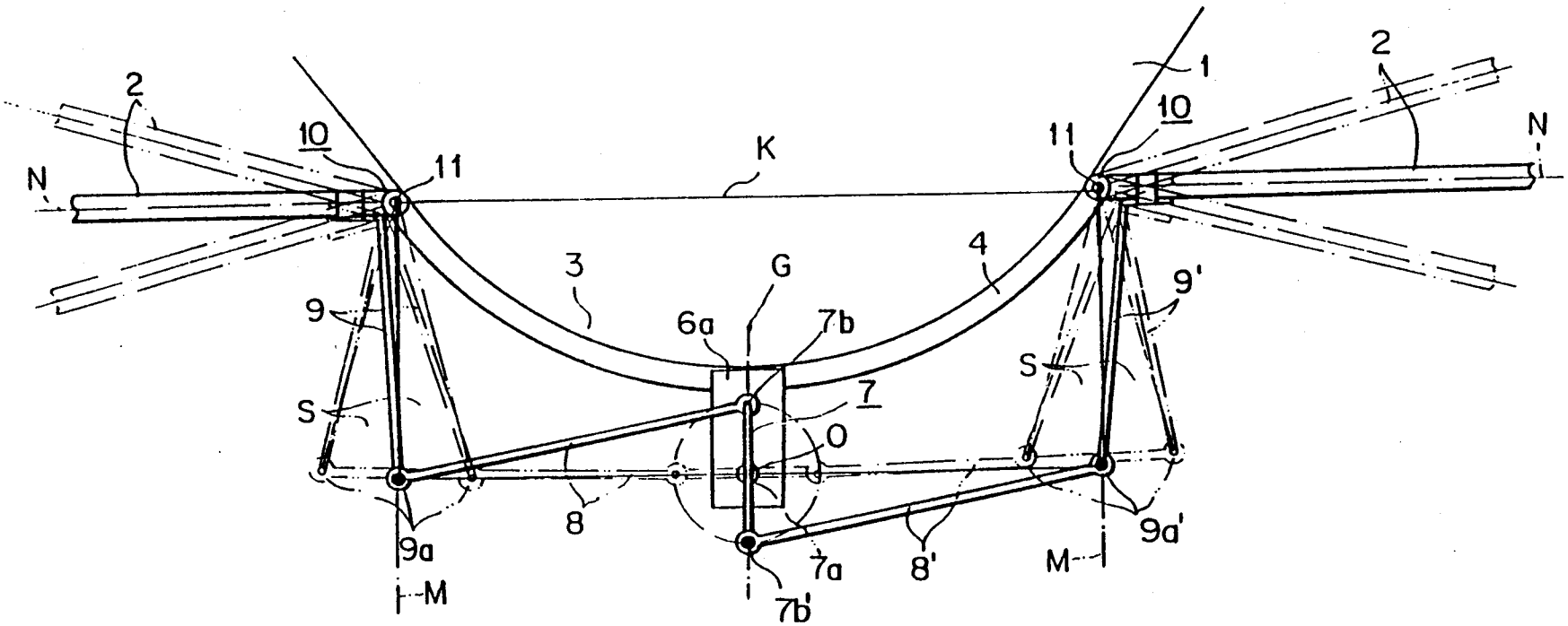
FIG. 8 is a front view of an essential portion of the floatable structure propelling mechanism of FIG. 6.

The floatable structure propelling mechanism 3 is attached to the lower surface of the floatable structure 1 by suitable means, such as an adhesive, with its center of gravity on a vertical line passing the center G of gravity of the floatable structure 1 as shown in FIG. 8.

Figure 7:
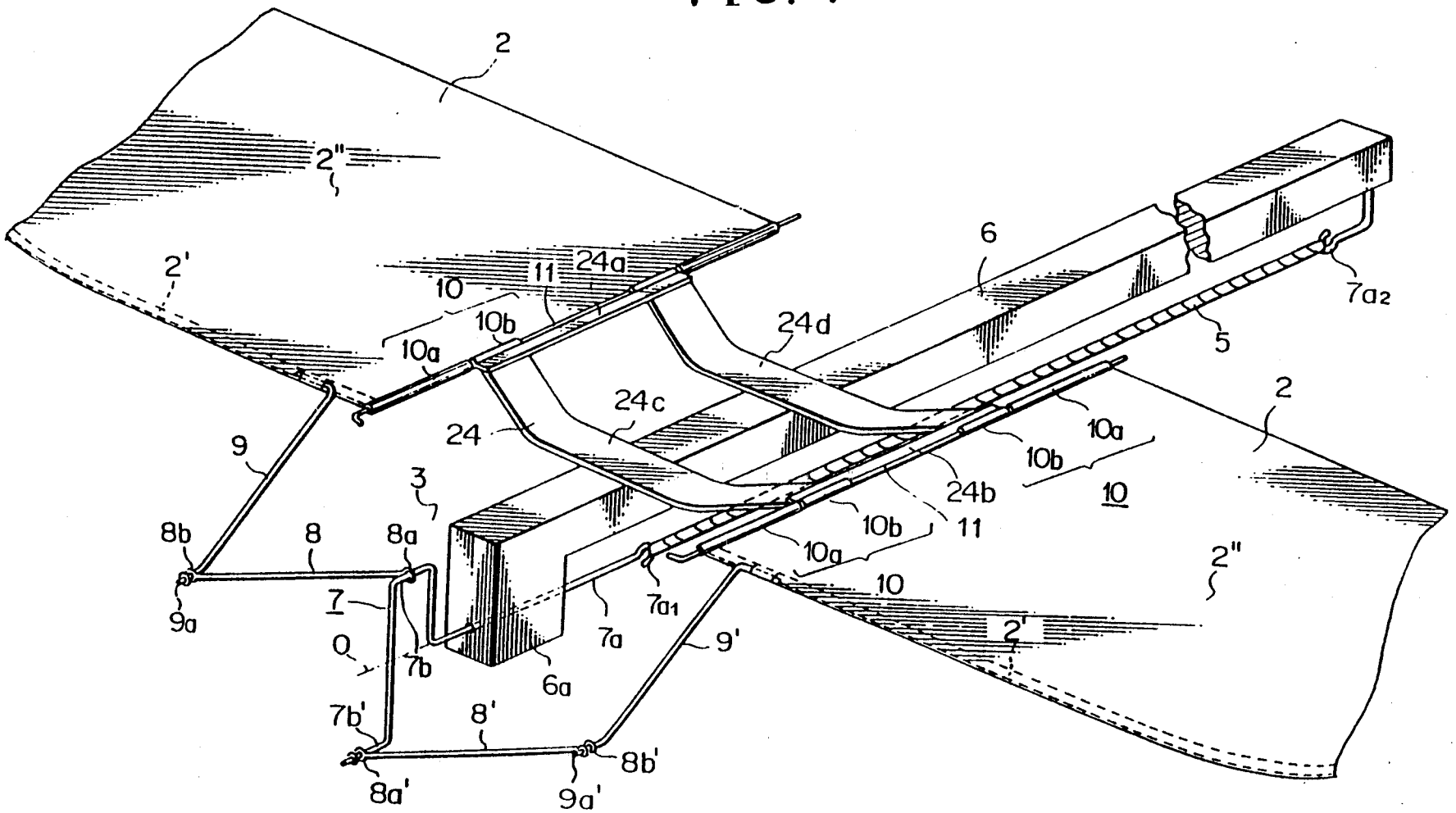
FIG. 7 is a perspective view of an essential portion of the floatable structure propelling mechanism of FIG. 6.

The construction of the floatable structure propelling mechanism 3 will be described hereinafter. Referring to FIGS. 7 and 8, the floatable structure propelling mechanism 3 comprises a support bar 6, a hook $7a_2$ attached to the rear end of the support bar 6, a double crankshaft 7 supported for rotation on a projection 6*a* formed at the front end of the support bar 6, and having a crank journal 7*a* and opposite crank pin portions 7*b* and 7*b*', a rubber cord 5 extended between the hook $7a_2$ and a hook $7a_1$ formed at the rear end of the crank journal 7*a* of the double crankshaft 7, a frame 24 consisting of opposite side members 24*a* and 24*b* and cross members 24*c* and 24*d*, and attached to the support bar 6, the lateral fins 2 pivotally supported for swing motion by hinges 10 on the side members 24*a* and 24*b* of the frame 24, respectively, first connecting rod 8 and 8' pivotally joined respectively to the crank pin portions 7*b* and 7*b*' of the double crankshaft 7, and second connecting rods 9 and 9' pivotally connected to the free ends of the first connecting rods 8 and 8' and fixedly connected to the lateral fins 2, respectively.

The cross members 24*c* and 24*d* of the frame 24 are curved so as to extend along the curved lower surface of the floatable structure 1.

Each hinge 10 consists of pipes 10*a* fixed to the base member of the lateral fin 2, pipes 10*b* fixed to the cross members 24*c* and 24*d* of the frame 24 coaxially with the pipes 10*a*, and a pin 11 extended through the pipes 10*a* and 10*b*.

Figure 9:
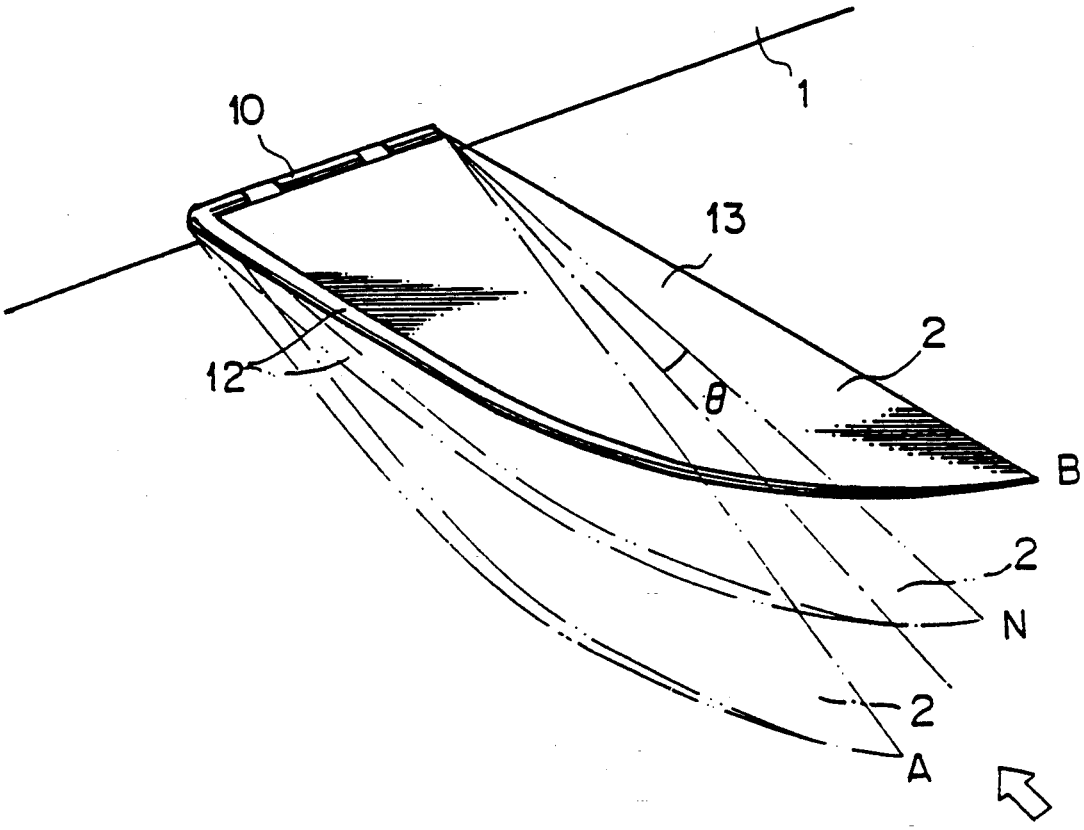
FIG. 9 is a perspective view of assistance in explaining the dynamic action of a lateral fin employed in the floatable structure propelling mechanism of FIG. 6.

As shown in FIG. 9, each lateral fin 2 is formed in a substantially triangular shape tapered off toward the tip and resembling the pectoral fin of a fish by spreading a film 2'' on a framework 2' formed of a lightweight, flexible members, such as bamboo wires, or by molding a plastic. The film 2'' is spread slightly loosely so that portions of the lateral fin 2 near the tip and the trailing edge will increasingly flex and the lateral fin 2 may swell to produce lift and propulsion efficiently when the lateral fin 2 is swung in a vertical plane.

The geometry of the floatable structure propelling mechanism 3 is determined so that the lateral fins 2 extend in substantially horizontal neutral positions N when the double crankshaft 7 of the rotative driving unit is at a neutral position as shown in FIG. 8. When the double crankshaft 7 is rotated, the lateral fins 2 swing on the hinges 10 alternately up and down with respect to the neutral positions N.

The floatable structure propelling mechanism 3 is assembled beforehand and the same is incorporated into the floatable structure 1 by attaching the frame 24 to the floatable structure 1 by suitable means, such as an adhesive.

When the floatable structure 1 is released into the air after fully twisting the rubber cord 5 to store sufficient energy, the floatable structure 1 filled with helium gas floats in the air and is propelled by the propulsion of the lateral fins 2 being swung alternately up and down by the double crankshaft 7. The weight and disposition of the ballast is adjusted properly so that the floatable structure floats in the air in a balanced attitude and turns in a desired direction.

The dynamic performance of the lateral fins 2 will be described hereinafter with reference to FIGS. 9 to 11.

Figure 10:
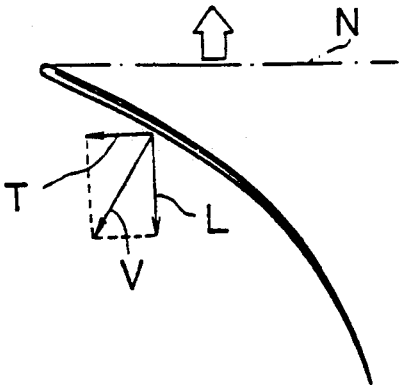
FIG. 10 is a diagrammatic view of assistance in explaining the dynamic actions of the lateral fin when the lateral fin swings upward.

During the upward swing of each lateral fin 2 from the lower limit position A through the neutral position N to the upper limit position B, the lateral fin 2 is bent in an upwardly convex curve as shown in FIG. 10 by the resistance of air represented by a force V acting perpendicularly to the surface of the lateral fin 2. The horizontal component T of the force V thrusts the floatable structure 1 forward and the vertical component L of the force V depresses the floatable structure 1. During the downward swing of each lateral fin 2 from the upper limit position B through the neutral position to the lower limit position A, the lateral fin 2 is bent in a downwardly convex curve as shown in FIG. 11 by the resistance of air represented by a force $V_1$ acting perpendicularly to the surface of the lateral fin 2. The horizontal component $T_1$ of the force $V_1$ thrusts the floatable structure 1 forward and the vertical component $L_1$ lifts up the floatable structure 1. The swinging speed of the lateral fin 2 is higher for downward swing than for upward swing because the downward swing of the lateral fin 2 is assisted by the gravity of the lateral fin 2. The absolute values of the forces acting on the lateral fin 2 meet the following inequalities.

$$V < V_1 \quad (1)$$
$$T < T_1 \quad (2)$$
$$L < L_1 \quad (3)$$

Since $L_1 > L$, the floatable structure 1 can be advanced and lifted when the lateral fins 2 are swung by the rotative driving unit even if the total weight of the floatable structure 1 and the floatable structure propelling mechanism 3, and the buoyancy of the helium gas are determined so that the floatable structure 1 falls gradually while the lateral fins 2 are stopped. Both the components T and $T_1$ act as a thrust.

When the area of the lateral fins 2 is fixed, the components T and $T_1$ acting as a thrust is proportional to the force V, which can be increased by increasing the angular range of swing motion of the lateral fins 2.

Thus, the lateral fins 2 are driven efficiently for swing motion on the hinges 10 through the double crankshaft 7, the first connecting rods 8 and 8' and the second connecting rods 9 and 9' by the energy stored in the twisted rubber cord 5, so that the floatable structure 1 is able to fly slowly for a long time.

Figure 12:
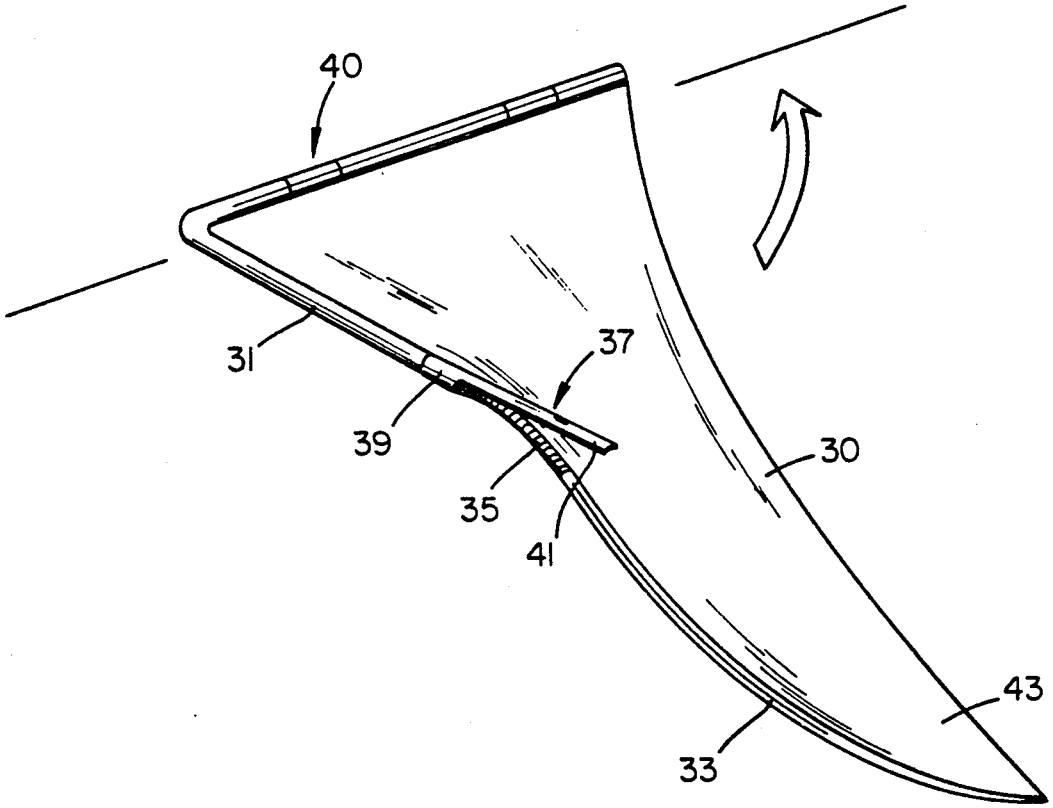
FIG. 12 is a perspective view of another embodiment of the lateral fin when the lateral fin swings upward.
Figure 13:
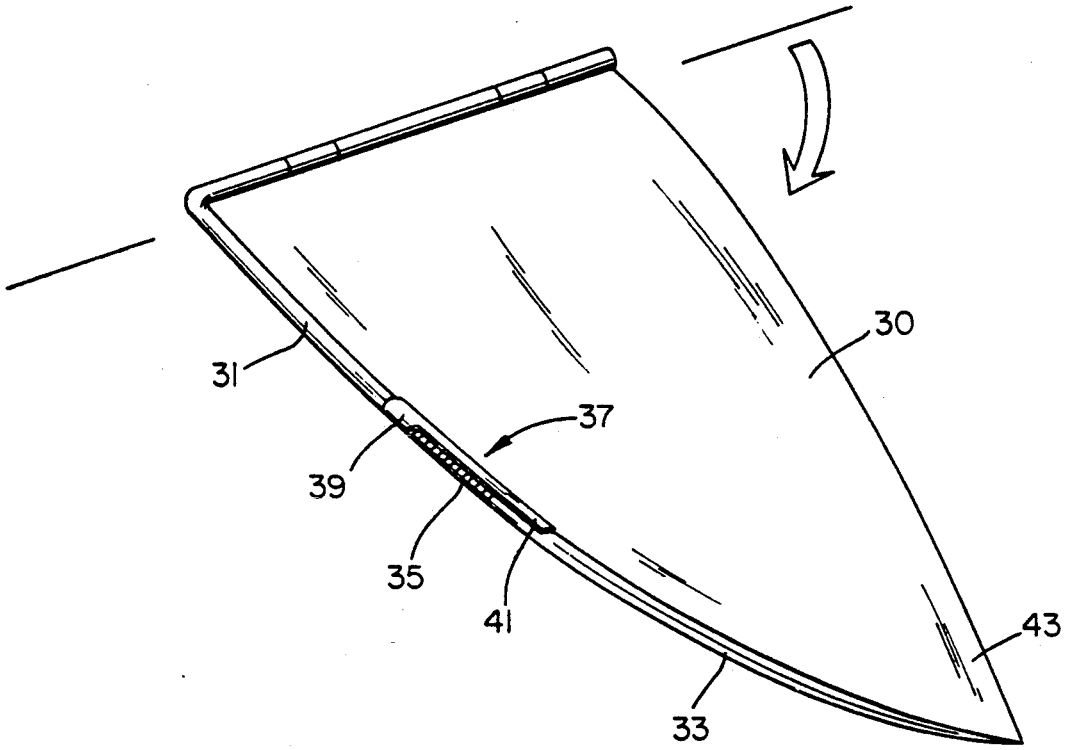
FIG. 13 is a perspective view of the lateral fin depicted in FIG. 12 when the lateral fin swings downwardly.

Another embodiment of the lateral fins 2 depicted in FIGS. 7 and 9 is illustrated in FIGS. 12 and 13. With particular reference to FIG. 12, a lateral fin 30 is illustrated having a hinge mechanism 40 to permit upward and downward movement of the lateral fin 30. It should be understood that the lateral fin 30 is constructed in a similar manner as disclosed above for the lateral fins illustrated in FIGS. 7 and 9.

The framework of the lateral fin 30 includes first and second members 31 and 33. Members 31 and 33 are connected by a coil spring 35. In addition, a stopper 37 is provided in relationship to the members 31, 33 and 35.

The stopper 37 includes a first portion 39 which is fixedly connected to the distal end of the member 31. Extending outwardly from the first portion 39 is an arm 41. The arm 41 extends beyond the coil spring 35 such that the distal end thereof can removably engage the member 33.

In a preferred embodiment, the arm 41 is curved in transverse shape so as to accommodate the cylindrical shape of the coil spring 35 and engagement with the member 33. The portion 39 may also be cylindrical to facilitate connection to the member 31.

The stopper 37 and coil spring 35 are designed to configure the fin 30 between a flexed and relaxed state, see FIG. 12, and a rigid and tensioned state, see FIG. 13.

With reference again to FIG. 12, the fin 30 is shown in the maximum downward state for movement in an upward direction as indicated by the arrow. As the lateral fin moves upwardly, the distal end 43 thereof is caused to moved downwardly as a result of air resistance. This downward movement on the distal end 43 causes the coil spring 35 to flex such that the fin 30 is in a relaxed state during upward motion.

With reference to FIG. 13, the fin 30 is shown in a downward motion. During downward motion of the lateral fin 30, the air resistance forces the distal end of the wing 43 upwardly so as to straighten coil spring 35 and cause member 33 to engage the stopper arm 41 of the stopper 37. In this configuration, the framework of the lateral fin is in a rigid configuration such that the framework is generally aligned in the same plane as the fin material. In this configuration, the fin 30 is tensioned to provide improved lift as will be described hereinafter.

It should be understood that, although a coil spring is depicted disposed between the frame members 31 and 33, any elongate frame member capable of flexing between the positions depicted in FIGS. 12 and 13 may be utilized in conjunction with the lateral fin framework as described above. For example, a pivoting or hinge means may be substituted for the coil spring 35.

The improved lift associated with the lateral fin depicted in FIGS. 12 and 13 will now be described. It should be noted that the dynamic performance of the lateral fins 30 is improved over the lateral fins 2 described in FIGS. 10 and 11. With reference to FIG. 14 and the lower limit position A, neutral position N and upper limit position B shown in FIG. 9, during the upward swing of each lateral fin 30 from the lower limit position A through the neutral position N to the upper limit position B, the lateral fin 30 is bent in a upwardly convex curve as shown in FIG. 14 by the resistance of air represented by a force $V_2$ acting perpendicularly to the surface of lateral fin 30. The force $V_2$ is shown divided into a horizontal component $T_2$ which thrusts the floatable structure forward and a vertical component $L_2$ of the force $V_2$ which depresses the floatable structure 1. With reference to FIGS. 9 and 15, during the downward swing of each lateral fin 30 from the upper limit position B through the neutral position N to the lower limit position A, the lateral fin 30 is bent in a downwardly convex curve by the resistance of air represented by the force $V_2'$ acting perpendicularly to the surface of the lateral fin 30. The horizontal component of the component $V_2'$ is shown in FIG. 15 as component $T_2'$ which thrusts the floatable structure forward. The vertical component $L_2'$ of the force $V_2'$ lifts up the floatable structure 1.

Figure 11:
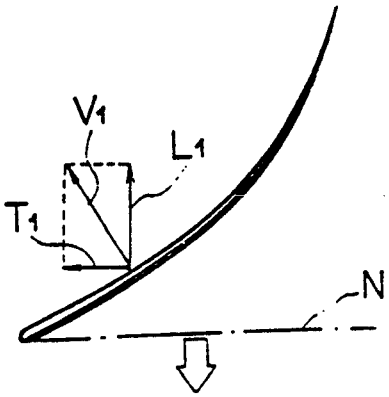
FIG. 11 is a diagrammatic view of assistance in explaining the dynamic action of the lateral fin when the lateral fin swings downward.

As described above concerning the dynamic performance of the lateral fins 2 depicted in FIGS. 9–11, the difference in the vertical components of the force enable the floatable structure to be advanced and lifted. With reference again to FIG. 14, the vertical component $L_2$, is much less than the vertical component $L_2'$ when compared to the vertical components L and $L_1$ shown in FIGS. 10 and 11. The reasoning for the greater difference in vertical components is the presence of the flexing coil spring 35 in the lateral fin 30. During the upward motion of the lateral fin 30, the lateral fin 30 is in a relaxed state resulting in a lower resistance to air, i.e., a smaller $L_2$ force component. During downward motion of the lateral fin 30, see FIG. 15, the lateral fin 30 is in a tensioned and rigid configuration resulting in a greater $L_2'$ component. Since the difference between the vertical components contributes to the lift of the floatable structure, a greater lift is achieved by the lateral fin 30 and the flexing feature as described above. Thus, the lateral fins 30 provide an improved propelling function for the floatable structure.

In yet another embodiment of the invention, a tail portion of the floatable structure depicted in FIG. 6 is illustrated in FIG. 16. The floatable structure 1 includes a fin 51 having an additional rotative driving unit 53 disposed therein. The rotative driving unit 53 includes a rotor 55 adapted to be powered by a motive power source (not shown). The motive power source is designed to rotate the rotor 55 clockwise or counterclockwise depending on the steering action desired for the floatable structure 1. Operation of the rotative driving unit 53 permits the floatable structure to be steered to the left or right during forward motion travel.

Since these types of miniature rotative drive unit driven by a battery source are well known, further details are not included. It should also be noted that, operation of the rotative driving unit 53 may be controlled by a radio receiver and radio transmitter arrangement as described hereinafter for remote control steering of the floatable structure 1.

The rubber cord 5 may be substituted by a motor, a spiral spring, a miniature engine or any suitable rotative driving means. When the floatable structure 1 is provided with a floatable structure propelling mechanism employing a miniature engine, the floatable structure 1 may be provided with a radio receiver to control the miniature engine by means of a radio transmitter for the remote control of the floatable structure 1.

The floatable structure propelling mechanism may be provided with a plurality of pairs of lateral fins.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A floatable structure propelling mechanism for propelling a floatable structure in a rearward-to-forward direction, comprising:

a pair of lateral fins provided on respective lateral sides of said floatable structure and extending laterally outward away from the floatable structure;

hinge means secured to said lateral sides of the floatable structure for pivotally mounting said lateral fins to the lateral sides, respectively, each of said hinge means extending along each of said lateral sides in a direction parallel to said rearward-to-forward direction in a manner to allow each lateral fin to swing up and down about each hinge means;

each of said lateral fins having a forward frame extending laterally outward from each of said hinge means so as to be curved rearwardly as it extends outward, and a flexible film spread between each hinge means and the forward frame said forward frame including means to angle said forward frame during upward motion of each said lateral fin and relax said flexible film and to straighten said forward frame during downward motion of each said lateral fin and tension said flexible fin, such that each said lateral fin produces a lift and a propulsion thrust as each lateral fin is swung downwardly and upwardly; and rotative driving means mounted on said floatable structure, said driving means having a rotative drive source and connecting means operatively coupling said drive source to said lateral fins such that said drive source causes the lateral fins to swing about respective said hinge means.

2. The floatable structure propelling mechanism of claim 1 wherein said means to angle and straighten said forward frame further comprises a coil spring disposed as part of said forward frame and a stopper element attached to said forward frame to straighten said forward frame by preventing angulation of said coil spring.

3. The floatable structure propelling mechanism of claim 2 wherein each said forward frame comprises a first elongated member extending from a respective hinge, a second elongated member wherein said coil spring is disposed between said first and second elongated members and said stopper element is fixedly connected at one end thereof to said first elongated member and removably engageable with said second elongated member at the other end.

4. A floatable structure propelling mechanism according to claim 1, wherein said connecting means comprises a crankshaft coupled to said drive source and connecting rods operatively connecting the crankshaft to respective said forward frames of the lateral fins.

5. A floatable structure propelling mechanism according to claim 4, wherein said crankshaft is a double crankshaft having two crank pins and said connecting rods are connected to respective said crank pins.

6. A floatable structure propelling mechanism according to claim 4, wherein each of said connecting rods comprises a pair of mutually pivoted rods.

7. A floatable structure propelling mechanism according to claim 4, wherein said connecting rods are connected to the forward frames adjacent the hinge means.

8. A floatable structure propelling mechanism according to claim 1, wherein each of said lateral fins is in the form of a substantially triangular pectoral fin of a fish.

9. A novelty floatable structure comprising:

a) an inflatable structure adapted to be filled with a gas lighter than air; and b) a floatable structure propelling mechanism for propelling said inflatable structure comprising:

a pair of lateral fins provided on respective lateral sides of said floatable structure and extending laterally outward away from the inflatable structure;

hinge means secured to said lateral sides of the inflatable structure for pivotally mounting said lateral fins to the lateral sides, respectively, each of said hinge means extending along each of said lateral sides in a direction parallel to said rearward-to-forward direction in a manner to allow each lateral fin to swing up and down about each hinge means;

each of said lateral fins having a forward frame extending laterally outward from each of said hinge means so as to be curved rearwardly as it extends outward, and a flexible film spread between each hinge means and the forward frame, said forward frame including means to angle said forward frame during upward motion of each said lateral fin and relax said flexible film and to straighten said forward frame during downward motion of each said lateral fin and tension said flexible fin, such that each said lateral fin produces a lift and a propulsion thrust as each lateral fin is swung downwardly and upwardly; and rotative driving means mounted on said inflatable structure, said driving means having a rotative drive source and connecting means operatively coupling said drive source to said lateral fins such that said drive source causes the lateral fins to swing about respective said hinge means.

10. The novelty floatable structure of claim 9 wherein said means to angle and straighten said forward frame further comprises a coil spring disposed as part of said forward frame and a stopper element attached to said forward frame to straighten said forward frame by preventing angulation of said coil spring.

11. The novelty floatable structure of claim 10, wherein each said forward frame comprises a first elongated member extending from a respective hinge, a second elongated member wherein said coil spring is disposed between said first and second elongated members and said stopper element is fixedly connected at one end thereof to said first elongated member and removably engageable with said second elongated member at the other end.

12. A novelty floatable structure according to claim 9, wherein said connecting means comprises a crankshaft coupled to said drive source and connecting rods operatively connecting the crankshaft to respective said forward frames of the lateral fins.

13. A novelty floatable structure according to claim 12, wherein said crankshaft is a double crankshaft having two crank pins and said connecting rods are connected to respective said crank pins.

14. A novelty floatable structure according to claim 12, wherein each of said connecting rods comprises a pair of mutually pivoted rods.

15. A novelty floatable structure according to claim 12, wherein said connecting rods are connected to the forward frames adjacent the hinge means.

16. A novelty floatable structure according to claim 9, wherein each of said lateral fins is in the form of a substantially triangular pectoral fin of a fish.

* * * * *